US008019616B2

(12) United States Patent
Lee et al.

(10) Patent No.: US 8,019,616 B2
(45) Date of Patent: Sep. 13, 2011

(54) METHOD AND APPARATUS FOR ENCODING AUDIO SIGNAL, AND METHOD AND APPARATUS FOR DECODING AUDIO SIGNAL

(75) Inventors: Nam-suk Lee, Suwon-si (KR); Geon-hyoung Lee, Hwanseong-si (KR); Jae-one Oh, Yongin-si (KR); Chul-woo Lee, Suwon-si (KR); Jong-hoon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 886 days.

(21) Appl. No.: 11/962,174

(22) Filed: Dec. 21, 2007

(65) Prior Publication Data

US 2008/0235033 A1 Sep. 25, 2008

(30) Foreign Application Priority Data

Mar. 20, 2007 (KR) ..... 10-2007-0027271

(51) Int. Cl.
*G10L 21/04* (2006.01)

(52) U.S. Cl. ..... 704/504; 704/501; 704/229

(58) Field of Classification Search ..... 704/500–504, 704/203, 205, 220, 222, 229, 221; 348/554, 348/558

See application file for complete search history.

(56) References Cited

U.S. PATENT DOCUMENTS

| | | | | |
|---|---|---|---|---|
| 5,809,474 | A | 9/1998 | Park | |
| 5,886,276 | A | 3/1999 | Levine et al. | |
| 6,266,644 | B1 | 7/2001 | Levine | |
| 6,349,284 | B1 | 2/2002 | Park et al. | |
| 6,487,535 | B1 | 11/2002 | Smyth et al. | |
| 7,246,065 | B2 * | 7/2007 | Tanaka et al. | 704/500 |
| 2005/0246164 | A1 | 11/2005 | Ojala et al. | |
| 2007/0106502 | A1 | 5/2007 | Kim et al. | |

FOREIGN PATENT DOCUMENTS

| | | | |
|---|---|---|---|
| EP | 0918401 | B1 | 3/2006 |
| JP | 10285402 | A | 10/1998 |
| JP | 2000068852 | A | 3/2000 |
| KR | 10-0647336 | B1 | 11/2006 |

OTHER PUBLICATIONS

Communication issued in counterpart Korean Application No. 10-2007-0027271 dated Apr. 22, 2011.

* cited by examiner

*Primary Examiner* — Huyen X. Vo
(74) *Attorney, Agent, or Firm* — Sughrue Mion, PLLC

(57) ABSTRACT

Methods and apparatuses for encoding and decoding of an audio signal using a mixture of a time-frequency method and a parametric method according to the audio band are provided. An encoding method of an audio signal includes: dividing input audio signals into a plurality of audio bands; selecting a coding method for each audio band; encoding each audio band according to the selected coding method for each band; and generating a bit stream including all the data encoded for each audio band, wherein selecting a coding method for each band comprises selecting smaller encoded data either from a parametric coding method or a time frequency coding method.

20 Claims, 4 Drawing Sheets

METHOD AND APPARATUS FOR ENCODING AUDIO SIGNAL, AND METHOD AND APPARATUS FOR DECODING AUDIO SIGNAL

CROSS-REFERENCE TO RELATED PATENT APPLICATION

This application claims priority from Korean Patent Application No. 10-2007-0027271, filed on Mar. 20, 2007 in the Korean Intellectual Property Office, the disclosure of which is incorporated herein in its entirety by reference.

BACKGROUND OF THE INVENTION

1. Field of the Invention

Apparatuses and methods consistent with the present invention relate to encoding and decoding of an audio signal, and more particularly, to encoding and decoding an audio signal which apply an effective coding method for each band by dividing the audio signal into a plurality of bands.

2. Description of the Related Art

An encoding method of an audio signal can be classified into a parametric coding method and a time-frequency coding method. In the case of the parametric coding method, an encoding efficiency is high when a bit rate of data is low. In other words, the encoding efficiency of the parametric coding method decreases as the bit rate increases. The time-frequency coding method is more effective than the parametric coding method when sound quality of the audio signal is high, that is, the bit rate is high. However, the time-frequency coding method is ineffective when the bit rate is low, since information on all frequency indices should be transmitted.

Thus, in order to improve the encoding efficiency, a related art method in which only either the parametric coding method or the time-frequency coding method is applied, has to be improved.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a method and apparatus for encoding an audio signal, in which the audio signal is divided into a plurality of bands and an efficient coding method is applied for each of the bands, and a computer readable recording medium having recorded thereon a program for executing the above described method.

The present invention also provides a method and apparatus for decoding an audio signal, in which a bit stream generated by the encoding method is decoded for each band, and a computer readable recording medium having recorded thereon a program for executing the above described decoding method.

According to an aspect of the present invention, there is provided a method of encoding an audio signal including, the method comprising: dividing an input audio signal into a plurality of audio bands; selecting a coding method for each of the audio bands; encoding audio data included in each of the audio bands according to the selected coding method for each of the bands; and generating a bit stream including all the encoded audio data for each of the audio bands, wherein the selecting of the coding method comprises selecting a coding method providing smaller encoded data from among a parametric coding method and a time-frequency coding method.

The selecting the coding method for the each audio band may include: calculating a number of sinusoidal signals included in a corresponding audio band; selecting the time-frequency coding method when the number of sinusoidal signals is equal to or greater than a predetermined value; and selecting the parametric coding method when the number of sinusoidal signals is smaller than the predetermined value.

According to another aspect of the present invention, there is provided an apparatus for encoding an audio signal including: a band divider which divides an input audio signal into a plurality of audio bands; a coding method selector which selects a coding method for each of the audio bands; an audio encoder which encodes audio data included in each of the audio bands according to the selected coding method for each of the bands; and a bit stream generator generating a bit stream including all the encoded audio data for each of the audio bands, wherein the coding method selector selects a coding method providing smaller encoded data from among a parametric coding method and a time-frequency coding method.

The coding method selector may select the time-frequency coding method when the number of sinusoidal signals included in an audio band is equal to or greater than a predetermined value, and selects the parametric coding method when the number of sinusoidal signals is smaller than the predetermined value.

In the method and apparatus for encoding the audio signal, the parametric coding method may be a Sinusoidal Coding (SSC) method and the time-frequency coding method may be an Advanced Audio Coding (AAC) method.

According to another aspect of the present invention, there is provided a method of encoding an audio signal including: dividing an input audio signal into a plurality of audio bands; encoding audio data included in each of the audio bands by applying a parametric coding method and a time-frequency coding method respectively; selecting a coding method providing smaller data for each of the audio bands from among the encoded audio data using the parametric coding method and the time-frequency coding method; and generating a bit stream including all the encoded audio data selected for the each of the audio bands.

According to another aspect of the present invention, there is provided a method of decoding an audio signal including: dividing an input bit stream into audio data encoded for a plurality of audio bands; extracting information on a coding method used by an encoding apparatus for encoding the audio data, for each of the audio bands; decoding the encoded audio data for each of the audio bands, according to the coding method on the basis of the extracted information; and generating the audio signal by combining the decoded audio data for the respective audio bands, wherein the coding method is a coding method providing smaller encoded data that is selected from among a parametric coding method and a time-frequency coding method.

According to another aspect of the present invention, there is provided an apparatus of decoding an audio signal including: a bit stream divider which divides an input bit stream into audio data encoded for a plurality of audio bands; a coding method extractor which extracts information on a coding method used by an encoding apparatus for encoding the audio data, for each of the audio bands; an audio decoder which decodes the encoded audio data for each of the audio bands, according to the coding method on the basis of the extracted information; and an audio signal generator which generates the audio signal by combining the decoded audio data for each of the respective audio bands, wherein the coding method is a coding method providing smaller encoded data that is selected from among a parametric coding method and a time-frequency coding method.

In the methods and apparatuses of the decoding audio signal, the time-frequency coding method is selected as the coding method when the number of sinusoidal signals included in the corresponding audio band is equal to or greater than a predetermined value, and selects the parametric coding method when the number of sinusoidal signals is smaller than the predetermined value.

In the decoding method and apparatus, the parametric coding method may be an SSC method and the time-frequency method may be an AAC method.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Hereinafter, exemplary embodiments of the present invention will be described in detail with reference to the appended drawings.

Figure 1:
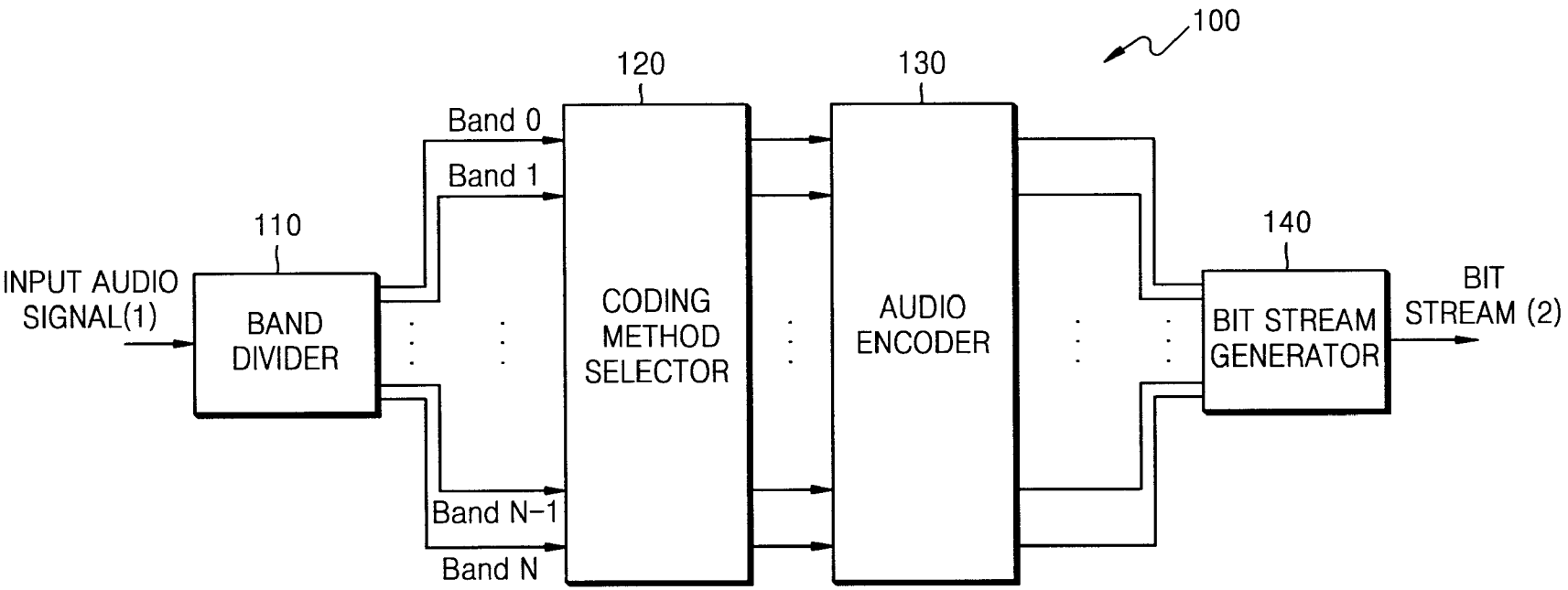
FIG. 1 is a block diagram of a structure of an audio signal encoding apparatus according to an exemplary embodiment of the present invention.
Figure 2:
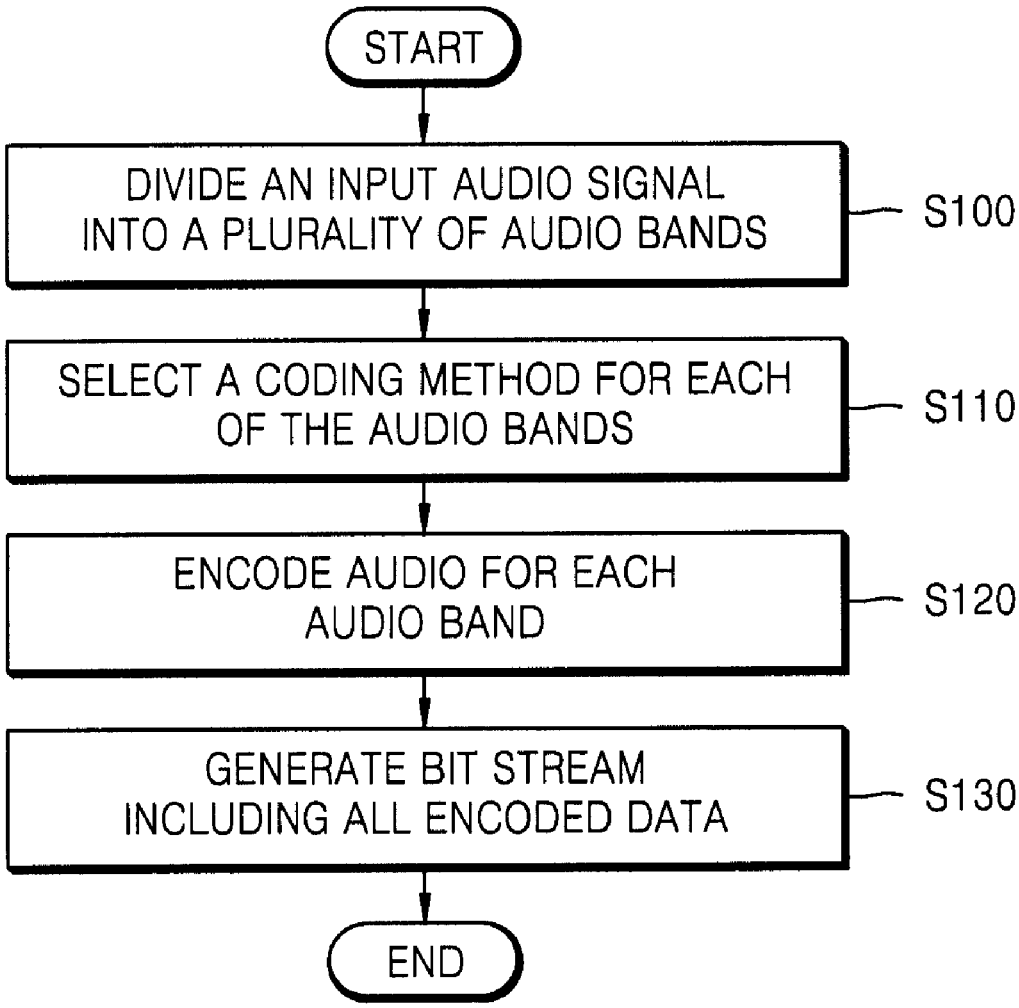
FIG. 2 is a flowchart of an audio signal encoding method according to an exemplary embodiment of the present invention.

FIG. 1 is a block diagram of a structure of an audio signal encoding apparatus 100 according to an exemplary embodiment of the present invention, and FIG. 2 is a flowchart of an audio signal encoding method according to an exemplary embodiment of the present invention.

Referring to FIG. 1, the audio signal encoding apparatus 100 may include a band divider 110, a coding method selector 120, an audio encoder 130, and a bit stream generator 140.

Referring to FIGS. 1 and 2, the band divider 110 divides an input audio signal 1 into a plurality of audio bands Band 0 through to Band N (S100).

The coding method selector 120 selects a coding method for each audio band (S110). The coding method selector 120 selects a more effective encoding method for a corresponding band from a parametric coding method and a time-frequency coding method. An effective encoding method denotes encoding by which encoded data is smaller than when encoded by using other methods.

A coding method selecting method according to an exemplary embodiment of the present invention will now be described. First, the number of sinusoidal signals included in the corresponding audio band, that needs to select a coding method, is calculated. When the calculated number of sinusoidal signals is equal to or greater than a predetermined value, a time-frequency coding method is selected. When the calculated number of sinusoidal signals is smaller than the predetermined value, a parametric coding method is selected. This coding method selecting method will be explained in more detail with reference to FIG. 5.

The audio encoder 130 encodes each audio band according to the coding method selected for the each audio band (S120).

When the parametric coding method is selected for a corresponding audio band, an audio signal included in the corresponding audio band is encoded by using the parametric coding method. An SSC method may be an example of the parametric coding method.

When the time-frequency coding method is selected for the corresponding audio band, an audio signal included in the corresponding audio band is encoded by using the time-frequency coding method. The time-frequency coding method denotes a coding method which converts data in the time domain into the frequency domain value. An AAC method may be an example of the time-frequency coding method.

The bit stream generator 140 generates a bit stream 2 which includes all of the encoded data for the each audio band (S130).

Figure 3:
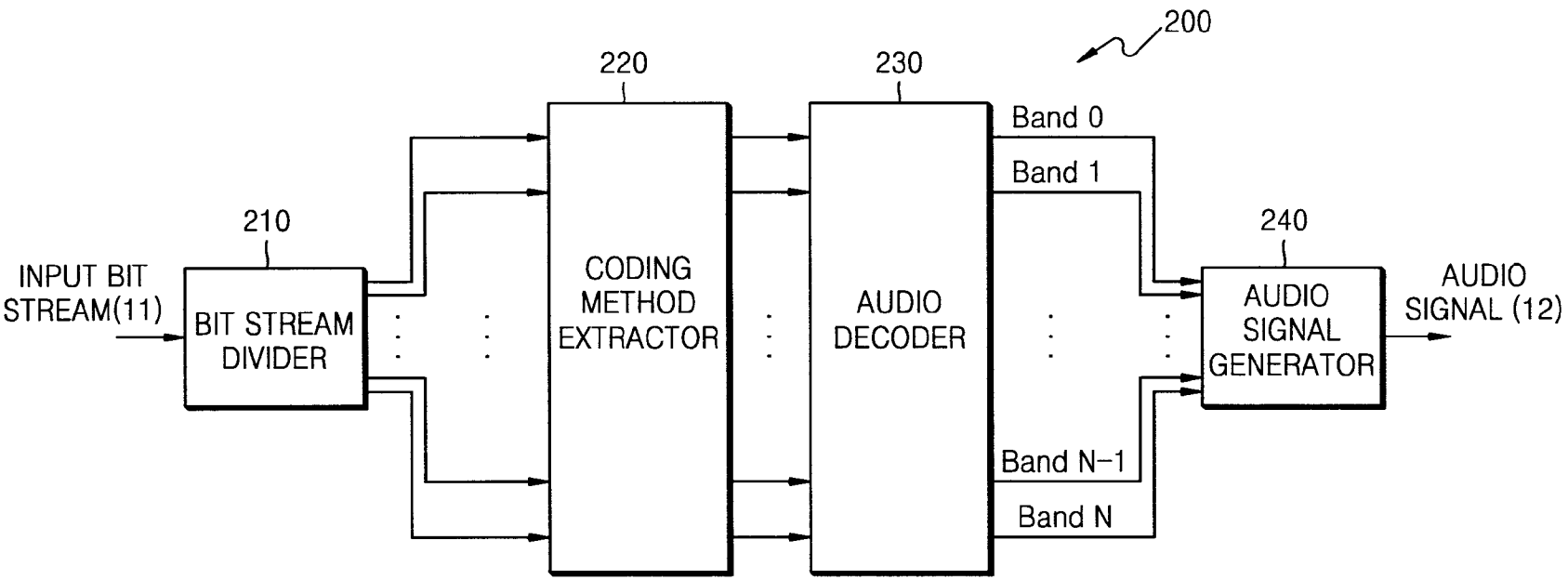
FIG. 3 is a block diagram of a structure of an audio signal decoding apparatus according to an exemplary embodiment of the present invention.
Figure 4:
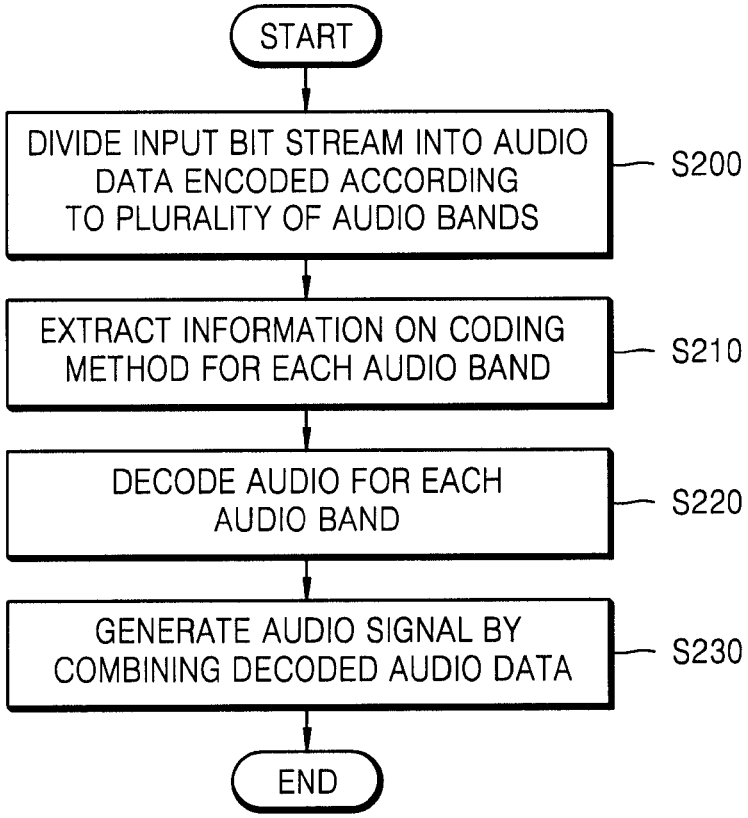
FIG. 4 is a flowchart of an audio signal decoding method according to an exemplary embodiment of the present invention.

FIG. 3 is a block diagram of a structure of an audio signal decoding apparatus 200 according to an exemplary embodiment of the present invention, and FIG. 4 is a flowchart of an audio signal decoding method according to an exemplary embodiment of the present invention.

Referring to FIG. 3, the audio signal decoding apparatus 200 may include a bit stream divider 210, a coding method extractor 220, an audio decoder 230, and an audio signal generator 240.

Referring to FIGS. 3 and 4, the bit stream divider 210 divides an input bit stream (11) into audio data encoded according to a plurality of audio bands (S200).

The coding method extractor 220 extracts information on the coding method for each of the audio bands (S210). The coding method is a method used for encoding audio data of the corresponding audio band in an encoding apparatus. As described above, the encoding apparatus selects a method that provides smaller encoded data from among the parametric coding method and the time-frequency coding method, for each audio band. As explained above, according to an exemplary embodiment of the present invention, the encoding apparatus calculates the number of sinusoidal signals included in an audio band to select a coding method, and selects the time-frequency coding method when the calculated number of sinusoidal signals is equal to or greater than a predetermined value or selects the parametric coding method when the calculated number of sinusoidal signals is smaller than the predetermined value.

The audio decoder 230 decodes audio data encoded according to the coding method based on the extracted information for the each audio band (S220).

When the information on a coding method for the corresponding audio band indicates the parametric coding method, encoded audio data for the corresponding audio band is decoded by using the parametric coding method. The SSC method is an example of the parametric coding method.

When the information on a coding method for the corresponding audio band indicates the time-frequency coding method, encoded audio data for the corresponding audio band is decoded by using the time-frequency coding method. The AAC is an example of the time-frequency method.

The audio signal generator 240 generates an output audio signal 12 by combining audio data decoded for each audio band (S230).

Figure 5:
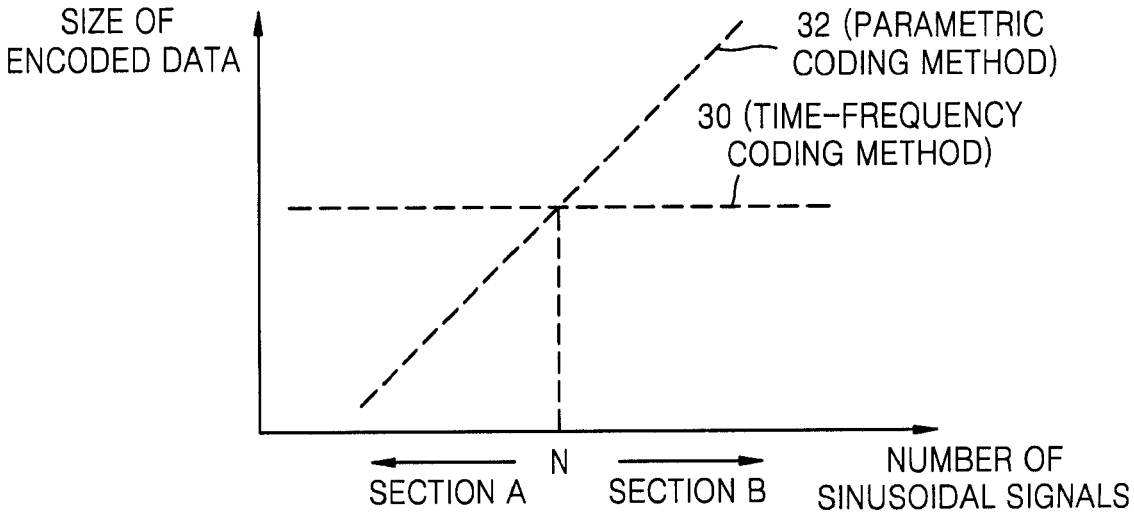
FIG. 5 illustrates changes in the size of encoded data according to the number of sinusoidal signals and a coding method.

A selection of the coding method according to the number of sinusoidal signals will now be explained in detail, with reference to FIG. 5. FIG. 5 illustrates changes in data size of encoded data according to the number of sinusoidal signals and a coding method.

In the time-frequency coding method, a fundamental frequency is set and amplitude values and phase values of all frequencies which are multiples of the fundamental frequency are extracted and encoded. Accordingly, the size of the encoded data stays the same since information on the same number of frequencies is encoded regardless of the number of sinusoidal signals included in the audio signal, as indicated by a horizontal line 30 parallel to the X-axis.

Meanwhile, in the parametric coding method, information on a frequency, an amplitude, and a phase value for each sinusoidal signal is encoded. Accordingly, as the number of sinusoidal signals increases, the size of encoded data increases, as indicated by a straight line 32 heading towards the top right hand side in FIG. 5.

Accordingly, as shown in FIG. 5, the time-frequency coding method is effective when the number of sinusoidal signals is greater than the predetermined value N in SECTION B, and the parametric coding method is effective when the number of sinusoidal signals is smaller than the predetermined value N in SECTION A.

There are various ways to determine the value N.

The value N is the number of sinusoidal signals where the size of the data encoded by using the parametric coding method and the size of data encoded by using the time-frequency coding method are the same. Accordingly, the number of frequencies used in the time-frequency coding method, namely, the number of frequency indices, may be selected as the value N. The value N will be slightly less than the number of frequency indices, since information on a frequency is not encoded in the time-frequency coding method.

Alternatively, instead of determining a value N in advance, a method of applying the parametric coding method and the time-frequency coding method to a corresponding audio band and selecting smaller encoded data from the two pieces of encoded data obtained by using the parametric coding method and the time-frequency coding method may be considered.

The invention can also be embodied as computer (including all devices having data processing functions) readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices.

As described above, in the methods and apparatuses for encoding an audio signal, and the methods and apparatuses for decoding an audio signal according to exemplary embodiments of the present invention, by dividing the audio signal into a plurality of bands and selecting a coding method where the size of encoded data is small for each band, an effective encoding method is possible in comparison to a method of applying one coding method to the entire audio data. In other words, the exemplary embodiments of the present invention provide a method in which the time-frequency method and the parametric method are mixed and used according to each audio band.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of encoding an audio signal, the method comprising:

dividing an input audio signal into a plurality of audio bands;

selecting a coding method for each of the audio bands;

encoding audio data included in each of the audio bands according to the coding method selected for each of the bands; and generating a bit stream including all of the encoded audio data included in each of the audio bands, wherein the selecting the coding method comprises selecting a coding method providing smaller encoded data from among a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

2. The encoding method of claim 1, wherein the parametric coding method is a Sinusoidal Coding method.

3. The encoding method of claim 1, wherein the time-frequency coding method is an Advanced Audio Coding method.

4. The encoding method of claim 1, wherein the selecting the coding method for each of the audio bands comprises:

calculating a number of sinusoidal signals included in a corresponding audio band among the plurality of audio bands;

selecting the time-frequency coding method if the number of sinusoidal signals is equal to or greater than a predetermined value; and selecting the parametric coding method if the number of sinusoidal signals is less than the predetermined value.

5. A method of encoding an audio signal, the method comprising:

dividing an input audio signal into a plurality of audio bands;

encoding audio data included in each of the audio bands according to each of a parametric coding method and a time-frequency coding method;

selecting smaller data for each of the audio bands from among the encoded audio data using the parametric coding method and the time-frequency coding method; and generating a bit stream including all of the encoded audio data selected for each of the audio bands;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

6. An apparatus for encoding an audio signal, the apparatus comprising:

a band divider which divides an input audio signal into a plurality of audio bands;

a coding method selector which selects a coding method for each of the audio bands;

an audio encoder which encodes audio data included in each of the audio bands according to the coding method selected for each of the bands; and a bit stream generator which generates a bit stream including all of the encoded audio data for each of the audio bands, wherein the coding method selector selects a coding method providing smaller encoded data from among a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

7. The encoding apparatus of claim 6, wherein the parametric coding method is a Sinusoidal Coding method.

8. The encoding apparatus of claim 6, wherein the time-frequency coding method is an Advanced Audio Coding method.

9. The encoding apparatus of claim 6, wherein the coding method selector selects the time-frequency coding method if the number of sinusoidal signals included in a corresponding audio band among the plurality of audio bands is equal to or greater than a predetermined value, and selects the parametric coding method if the number of sinusoidal signals is less than the predetermined value.

10. A method of decoding an audio signal, the method comprising:

dividing an input bit stream into audio data encoded for a plurality of audio bands;

extracting information on a coding method used by an encoding apparatus for encoding the audio data, for each of the audio bands;

decoding the encoded audio data for each of the audio bands, according to the coding method based on the extracted information; and generating the audio signal by combining the decoded audio data for the respective audio bands, wherein the coding method is a coding method providing smaller encoded data that is selected from among a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

11. The decoding method of claim 10, wherein the parametric coding method is a Sinusoidal Coding method.

12. The decoding method of claim 10, wherein the time-frequency coding method is an Advanced Audio Coding method.

13. The decoding method of claim 10, wherein the time-frequency coding method is selected as the coding method if the number of sinusoidal signals included in the corresponding audio band is equal to or greater than a predetermined value, and the parametric coding method is selected as the coding method if the number of sinusoidal signals is less than the predetermined value.

14. An apparatus for decoding an audio signal, the apparatus comprising:

a bit stream divider which divides an input bit stream into audio data encoded for a plurality of audio bands;

a coding method extractor which extracts information on a coding method used by an encoding apparatus for encoding the audio data, for each of the audio bands;

an audio decoder which decodes the encoded audio data for each of the audio bands, according to the coding method based on the extracted information; and an audio signal generator which generates the audio signal by combining the decoded audio data for each of the respective audio bands, wherein the coding method is a coding method providing smaller encoded data that is selected from a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

15. The decoding apparatus of claim 14, wherein the parametric coding method is a Sinusoidal Coding method.

16. The decoding apparatus of claim 14, wherein the time-frequency coding method is an Advanced Audio Coding method.

17. The decoding apparatus of claim 14, wherein the time-frequency coding method is selected as the coding method if the number of sinusoidal signals included in a corresponding audio band is equal to or greater than a predetermined value, and the parametric coding method is selected if the number of sinusoidal signals is smaller than the predetermined value.

18. A non-transitory computer readable recording medium having recorded thereon a computer program for executing an audio signal encoding method, the audio signal encoding method comprising:

dividing an input audio signal into a plurality of audio bands;

selecting a coding method for each of the audio bands;

encoding audio data included in each of the audio bands according to the coding method selected for each of the bands; and generating a bit stream including all the encoded audio data in each audio band, wherein the selecting the coding method comprises selecting a coding method providing smaller encoded data from among a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

19. A non-transitory computer readable recording medium having recorded thereon a computer program for executing an audio signal encoding method, the audio signal encoding method comprising:

dividing an input audio signal into a plurality of audio bands;

encoding audio data included in each of the audio bands by applying each of a parametric coding method and a time-frequency coding method respectively;

selecting smaller data from among the encoded audio data using each of two different coding methods for each of the audio bands; and generating a bit stream including all of the encoded audio data selected for each of the audio bands;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

20. A non-transitory computer readable recording medium having recorded thereon a computer program for executing an audio signal decoding method, the audio signal decoding method comprising:

dividing an input bit stream into audio data encoded for a plurality of audio bands;

extracting information on a coding method used by an encoding apparatus for encoding the audio data, for each of the audio bands;

decoding the encoded audio data for each of the audio bands, according to the coding method based on the extracted information; and generating the audio signal by combining the decoded audio data for the respective audio bands, wherein the coding method is a coding method providing smaller encoded data that is selected from among a parametric coding method and a time-frequency coding method;

wherein the selecting comprises determining which of the parametric coding method and the time frequency coding method would provide smaller encoded data for an audio band;

wherein if it is determined that the parametric coding method would provide smaller encoded data for the audio band, selecting the parametric coding method for the audio band;

wherein if it is determined that the time frequency coding method would provide smaller encoded data for the audio band, selecting the time frequency coding method for the audio band.

* * * * *